US007115012B2

(12) United States Patent
Aya et al.

(10) Patent No.: US 7,115,012 B2
(45) Date of Patent: Oct. 3, 2006

(54) METHOD FOR MANUFACTURING DISCHARGE TUBE USING HEAT FOR OXIDATION OF ADHENSION AREA OF ELECTRODE LEAD

(75) Inventors: Shinichi Aya, Kanagawa (JP); Yasuhiro Yamashina, Kanagawa (JP); Tsutomu Tobita, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 130 days.

(21) Appl. No.: 10/642,292

(22) Filed: Aug. 18, 2003

(65) Prior Publication Data

US 2004/0033753 A1 Feb. 19, 2004

(30) Foreign Application Priority Data

Aug. 16, 2002 (JP) ..... 2002-237579

(51) Int. Cl.

| | |
|---|---|
| ***H01J 9/00*** | (2006.01) |
| ***H01J 9/02*** | (2006.01) |
| ***H01J 9/18*** | (2006.01) |
| ***H05B 33/10*** | (2006.01) |

(52) U.S. Cl. ..... 445/26; 445/27; 65/59.2

(58) Field of Classification Search ..... 445/22, 445/26, 27; 65/59.1–59.7, 32.2
See application file for complete search history.

(56) References Cited

U.S. PATENT DOCUMENTS

| | | | | |
|---|---|---|---|---|
| 2,446,277 | A * | 8/1948 | Gordon | 174/50.63 |
| 3,544,294 | A * | 12/1970 | Goto | 65/40 |
| 4,086,075 | A * | 4/1978 | Ekkelboom et al. | 65/40 |
| 4,103,416 | A * | 8/1978 | Sakamoto | 29/827 |
| 4,163,656 | A * | 8/1979 | Monneraye et al. | 65/43 |
| 4,178,050 | A * | 12/1979 | Kiesel et al. | 445/27 |
| 4,271,345 | A * | 6/1981 | Palmer et al. | 219/677 |
| 6,000,982 | A * | 12/1999 | Nakamura et al. | 445/51 |
| 6,354,901 | B1 * | 3/2002 | Bundo et al. | 445/26 |
| 6,531,811 | B1 * | 3/2003 | Kudo et al. | 313/362.1 |
| 6,791,271 | B1 * | 9/2004 | Horiuchi et al. | 315/56 |

FOREIGN PATENT DOCUMENTS

| | | |
|---|---|---|
| JP | 7-18123 A | 4/1995 |
| JP | 8-236023 U | 9/1996 |

* cited by examiner

*Primary Examiner*—Mariceli Santiago
*Assistant Examiner*—Elizabeth Rielley
(74) *Attorney, Agent, or Firm*—Sughrue Mion, PLLC

(57) ABSTRACT

In a discharge tube manufacture line, electrode clamps are attached to both sides of an electrode lead except on a predetermined adhesion area to fix a glass bead. Then, a power section is driven to energize the area between the electrode clamps. The surface of the predetermined adhesion area is heated and oxidized. The glass bead is welded to the oxidized surface of the predetermined adhesion area.

9 Claims, 4 Drawing Sheets

METHOD FOR MANUFACTURING DISCHARGE TUBE USING HEAT FOR OXIDATION OF ADHESION AREA OF ELECTRODE LEAD

BACKGROUND OF THE INVENTION

1. Field of the Invention

The present invention relates to a method for manufacturing a discharge tube suitable for flash device of a simple camera, such as a lens-fitted photo film unit, in particular, a method that can reduce the manufacture process to realize cost reduction.

2. Explanations of the Prior Arts

A flash discharge tube is used in a flash device of a camera. The flash discharge tube is ordinarily manufactured in the following steps. After an electrode lead is inserted into a glass bead, the glass bead with the electrode lead is fixed to one end of a glass tube. Then, rare gas, such as xenon, is put into the glass tube from the other end thereof. Finally, the other end of the glass tube is sealed by the glass bead with the electrode.

Generally, a flash discharge tube is required to have sufficient performance lifetime for emitting light about 5000 times. In order to achieve this, the conventional flash discharge tube uses tungsten with high-melting point as an electrode, and a hard glass with approximately the same thermal expansion rate as tungsten is used to cover the tungsten in a tight manner. Tungsten electrode lasts a long time, but tungsten is expensive. In addition, the tungsten electrode can not be soldered directly. Thus a nickel pin is required for welding, and this results in further increase in cost.

In order to ensure good adhesion with the glass bead, the electrode lead needs to be oxidized at least in a predetermined adhesion area to fix the glass beads. Moreover, in order not to affect the electrode function as well as to ensure solder welding, oxidation of the surface of the electrode lead must be prevented at both ends of the electrode leads except the predetermined adhesion area.

JPA No.8-236023 discloses a manufacturing method of an electrode lead that consists of tungsten and nickel. According to the above patent, when the two materials are welded in the air by joining over the same axle, the whole surface of the electrode lead is oxidized by the heat generated in welding. Then, the glass bead is inserted into the electrode lead such that the glass bead is in contact with the predetermined adhesion area of the electrode lead. Finally, a gas burner heats the glass bead in deoxidation gas atmosphere to adhere the glass bead to the electrode lead. As welding of the two materials and oxidation treatment are simultaneously conducted in the manufacturing process, the number of processes can be reduced in comparison with the conventional method in which welding and oxidation treatment are separately conducted. Additionally, oxidation treatment is easily conducted to the electrode lead that has uneven surface.

Despite the above advantages, the electrode lead must be subject to deoxidation treatment in the area excluding the predetermined adhesion area. As a result, the glass bead is adhered to the electrode lead in reducing gas or hydrogen atmosphere so as to prevent the surface of the electrode lead excluding the predetermined adhesion area from being oxidized. As other deoxidation process, it is possible to remove oxide films by acid washing.

In the electrode lead with different materials, oxygen in the air naturally reacts with the whole electrode lead upon welding. It is necessary to have deoxidation treatment over the surface of the electrode lead except the predetermined adhesion area. In conducting deoxidation treatment by reducing gas, for example, an equipment to generate reducing gas atmosphere is required. As a result, the manufacture cost increases.

Low cost is desirable for a lens-fitted photo film unit including a flash unit. However, incorporating the discharge tube with such expensive materials increases the cost of the lens-fitted photo film unit. Particularly, the lens-fitted photo film unit does not need such a durable flash discharge tube because it is recycled after its usage. It is sufficient for the electrode lead of the lens-fitted photo film unit to emit light at most around 150 times including recycling and testing upon manufacture. For the purpose of cost reduction, Japanese Utility Model Laid-Open Publication No. 7-18132 discloses a discharge tube that uses an electrode lead of a single material, such as Kovar metal (alloy of nickel, iron, and cobalt). However, the above oxidize treatment can not be applied to this type of electrode lead, because it does not require the welding process to reduce the electrode lead.

SUMMARY OF THE INVENTION

An object of the present invention is to provide a method for manufacturing a discharge tube in which only the surface of a predetermined area of an electrode lead is oxidized regardless of the structure and shape of the electrode lead.

Another object of the present invention is to oxidize the predetermined area of the electrode lead at a low cost.

To attain the above objects, the discharge tube is manufactured by applying heat by use of a heat application device to the electrode lead to oxidize only a surface of a predetermined adhesion area of the electrode lead. A glass bead to seal the discharge tube is fixed to the adhesion area of the electrode lead.

The heat application device consists of a pair of electrode members and a power source that applies a predetermined voltage between the pair of electrode members to heat the adhesion area of the electrode lead. At least a portion of the electrode members to contact the electrode lead is made of a conductive material. A degree of oxidation of the adhesion area is adjusted by changing the voltage, the electric current, the energizing period of a power source, or a combination of thereof in an appropriate manner.

According to the preferred embodiment of the present invention, the heat application device is a laser device that irradiates laser light to the adhesion area of the electrode lead. Otherwise, it is an infrared light device that irradiates infrared light to the adhesion area of the electrode lead. It is also possible to adopt a heater device that applies heat to the adhesion area of the electrode lead without contacting the electrode lead. A ring-shaped ceramic heater with a hole to insert the electrode lead is preferable as a heater device. Furthermore, it is possible to use a high frequency induction heating device that is composed of a coil section that covers the adhesion area without contacting the electrode lead and a high frequency power source section that generates alternative current with high frequency to the coil section, thereby induction current is flown in the electrode lead to oxidize only the surface of the adhesion area.

According to the present invention, since only the surface of the adhesion area is oxidized regardless of the structure and shape of the electrode lead, the predetermined area of the electrode lead can be oxidized at a low cost.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE EMBODIMENTS

Figure 1:
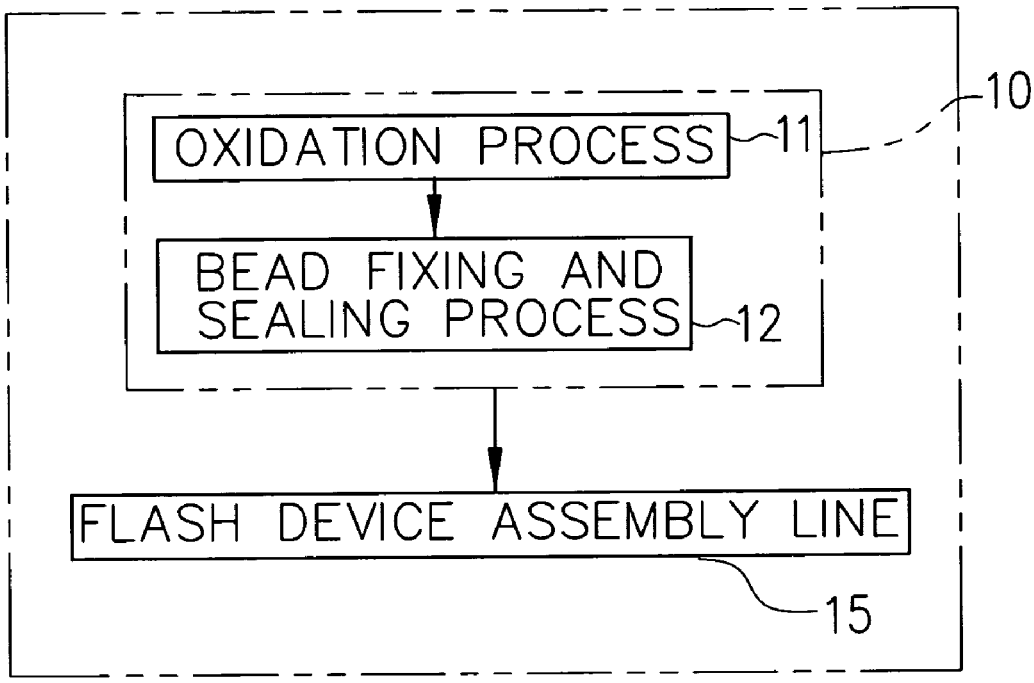
FIG. 1 is a flow chart illustrating an outline of a manufacturing process of a discharge tube of the present invention.

As shown in FIG. 1, a manufacture line 10 of a flash discharge tube consists of an oxidation process 11 and a bead fixing-and-sealing process 12. The flash discharge tube manufactured in the manufacture line 10 is conveyed to a flash device assembly line 15.

Figure 2:
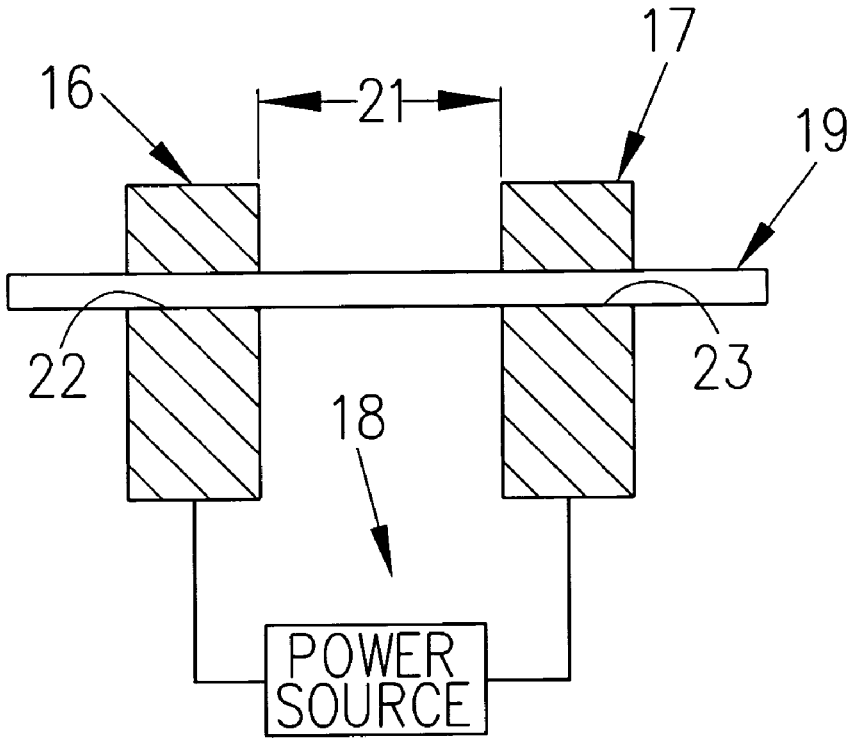
FIG. 2 is an explanatory view illustrating a process that electrode clamps deoxidize the surface of a predetermined adhesion area.

In the oxidation process 11, a heat application equipment is used to apply heat at a predetermined adhesion area of an electrode lead to fix a glass bead. The heat application equipment comprises a pair of electrode members and a power source 18 that applies a predetermined voltage between the pair of electrode members to heat the adhesion area of the electrode lead. A part of the pair of electrode members, namely, at least the portion to contact the electrode lead, is made of a conductive material. As shown in FIG. 2, electrode clamps 16, 17 are used as the electrode members in the present embodiment. An electrode lead 19 is made of an alloy of iron-nickel cobalt alloy (Kovar).

In the oxidation process 11, the electrode lead 19 is held at a predetermined position. Then, the electrode clamps 16, 17 are respectively clamped from a direction perpendicular to the axial direction of the electrode lead 19 to the areas that sandwich the adhesion area 21. Each electrode clamp 16, 17 has clamp sections 22, 23 to nip the electrode lead 19. Suitable clamp sections are used so that there is no space between the clamp and the electrode lead 19. The electrode clamps 16, 17 are connected to the power source 18. When the power source 18 is activated, the electrode lead 19 between the electrode clamps 16, 17 is heated due to the electrical current. Thereby, the surface of the electrode lead 19 reacts with oxygen in the air, to oxidize the predetermined adhesion area 21. Note that the degree of oxidation can be adjusted by changing the voltage, the electric current, the energizing period of the power source 18, or a combination of thereof in an appropriate manner.

Figure 3:
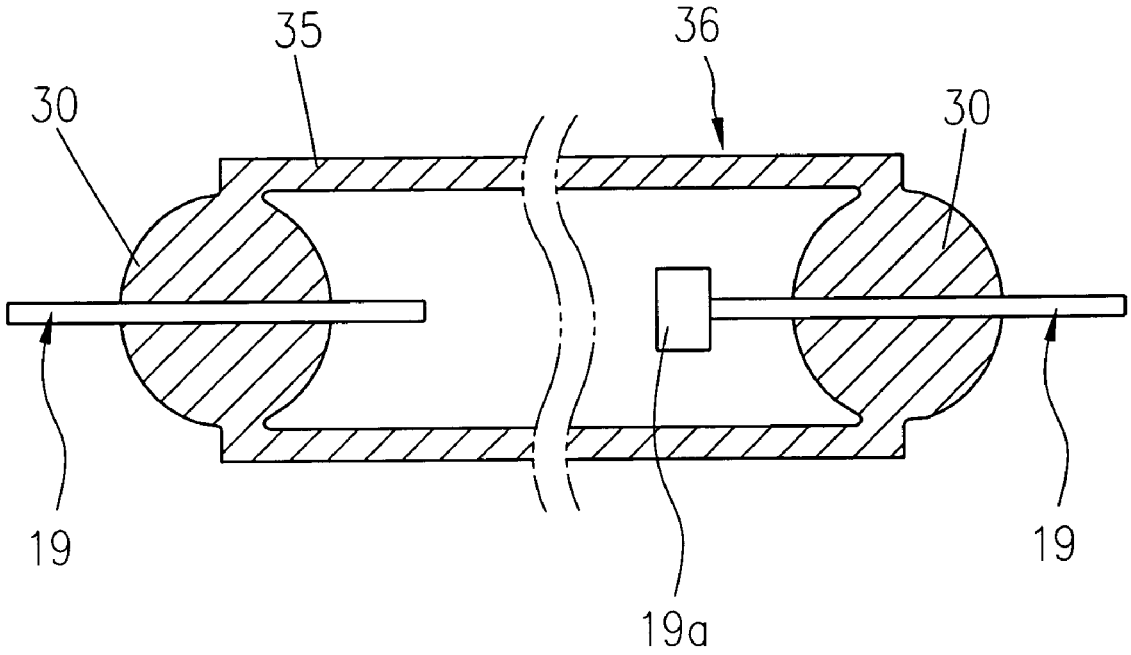
FIG. 3 is a sectional view illustrating the discharge tube.

In the bead fixing and sealing process 12, as shown in FIG. 3, a glass bead 30 is inserted into the electrode lead 19, and positioned at the adhesion area 21 to be fused. The fused electrode glass bead 30 is inserted into both ends of a glass tube 35 in the atmosphere of rare gas such as xenon. The electrode lead 19 is fixed to one end of the glass tube 35, while another electrode lead 19 is fixed to the other end of the glass tube 35. Upon heating the fixed glass tube 35 from outside to seal, a discharge tube 36 shown in FIG. 3 is completed. Note that it is after the oxidation process and before the sealing process of the glass tube 35 that a cathode member 19*a* is fixed to one end of the electrode lead 19 on the side of the glass tube 35.

Figure 4:
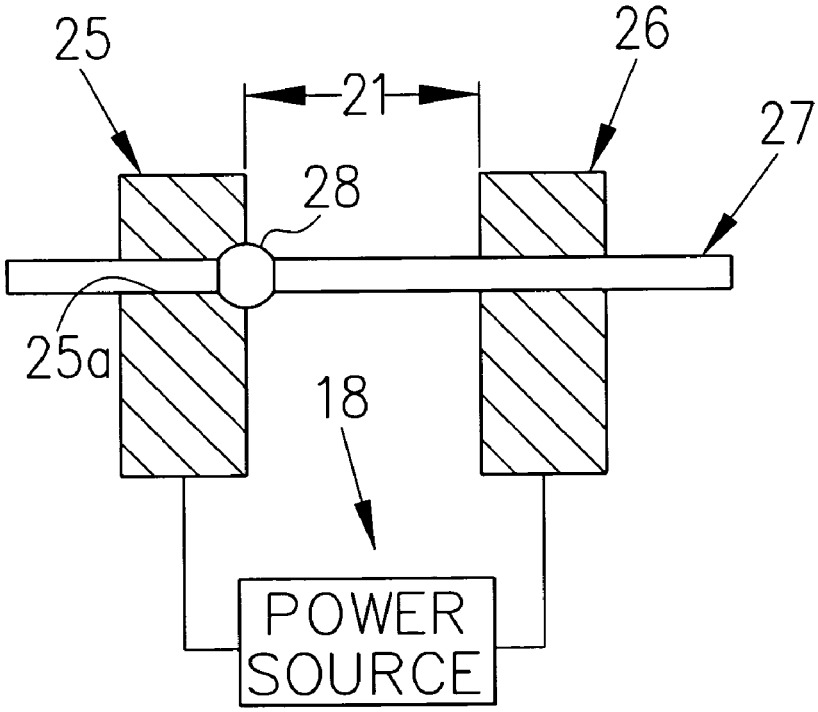
FIG. 4 is an explanatory view illustrating the process to oxidize an electrode lead having an uneven part.

In an example shown in FIG. 4, a convex section 28 bulged like a ball is formed in an electrode lead 27, such that efficient handling and easy positioning is achieved. Such convex section is formed at the joint part of different kinds of materials. In this example, the electrode lead 27 is integrally formed by two different types of materials, which consists of an inner lead inside the glass tube and an outer lead outside the glass tube. The electrode lead 27 has the convex section 28 between the inner lead and the outer lead. The electrode clamps 25 and 26 are connected to the power source 18. In the event of using the electrode lead 27 with the convex section 28, a clamp section 25*a* is partly depressed in order to fit the convex section 28. In the event that the electrode lead 27 with the convex section 28 is used on the cathode side, if the cathode member 19*a* is fixed at first, the convex section 28 prevents the glass bead 30 from being inserted into the adhesion area 21 of the electrode lead 27. Thus, the cathode member 19*a* is fixed after fusion of the glass bead 30 to the electrode lead 27.

Figure 5:
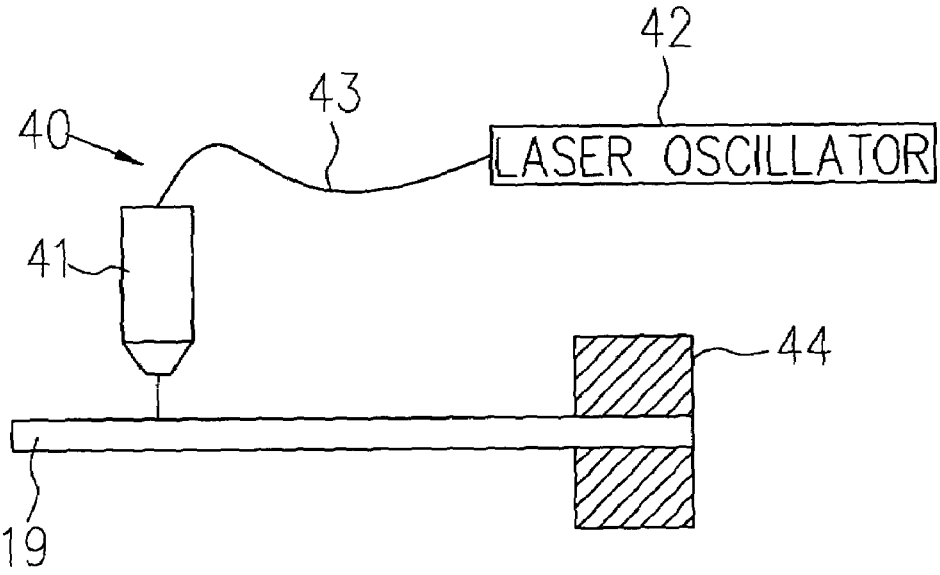
FIG. 5 is an explanatory view illustrating an embodiment in which laser light is irradiated to apply heat to the adhesion area.

FIG. 5 shows another embodiment in which laser light is irradiated to heat only the predetermined adhesion area of the electrode lead 19. A laser device 40 has a laser irradiation section 41, a laser oscillator 42, and a light guide 43. Laser light generated by the laser oscillator 42 is led to the laser irradiation section 41 via the flexible light guide 43. After the laser irradiation section 41 focuses its emitted rays to irradiate the electrode lead 19, only the adhesion area is heated without contacting the electrode lead 19. In heating the electrode lead 19 by non-contact heating, a part of the electrode lead 19, for instance, one end or both ends of the electrode lead 19, is held by a holding jig 44. It is also possible to limit the irradiation area by masking the electrode lead 19 except the adhesion area. Note that, if the adhesion area is larger than the irradiation area, the laser irradiation section 41 may be moved along the axis of the electrode lead 19. Further the holding jig 44 may be rotated around the axis of the electrode lead 19 so that laser light is irradiated around the electrode lead 19. The degree of oxidation can be adjusted by changing the output value, the irradiation period, the number of pulse of the laser oscillator 42, or combinations thereof appropriately.

Figure 6:
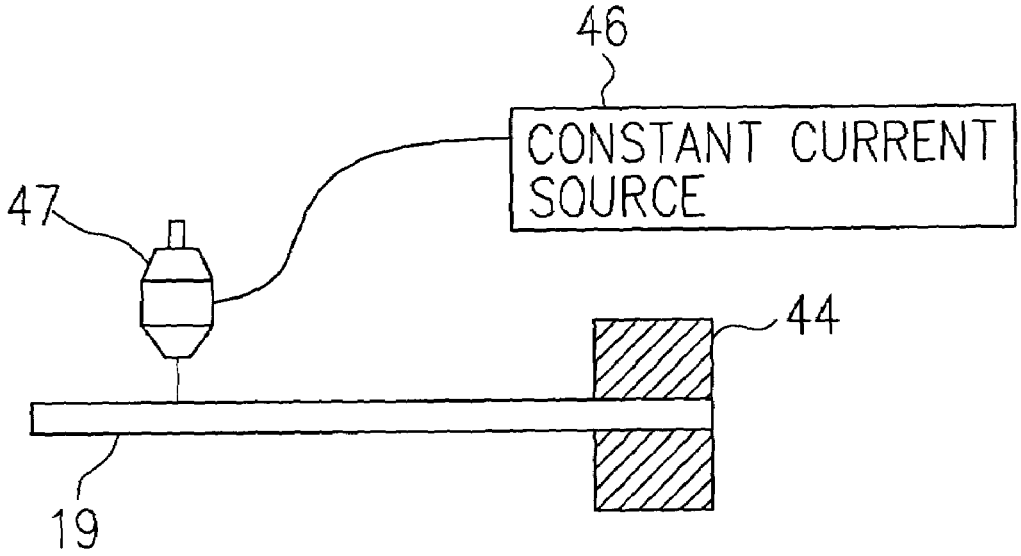
FIG. 6 is an explanatory view illustrating an embodiment in which infrared rays is irradiated to apply heat.

FIG. 6 shows an embodiment that irradiates infrared light to oxidize the surface of the adhesion area of the electrode lead 19. A constant current source 46, and an infrared light emitting section 47 are provided in this case. The infrared light emitting section 47 has an infrared lamp and a condensing optical system. On driving the regular current power section 46, the infrared light emitting section 47 turns on the infrared lamp. After the condensing optical system focuses infrared light to the electrode lead 19, only the predetermined adhesion area is heated without contacting the electrode lead 19. Similarly, the degree of oxidation can be changed by adjusting the output value, the irradiation period of the fixed electronic current battery section 46, or combinations of these appropriately.

Figure 7:
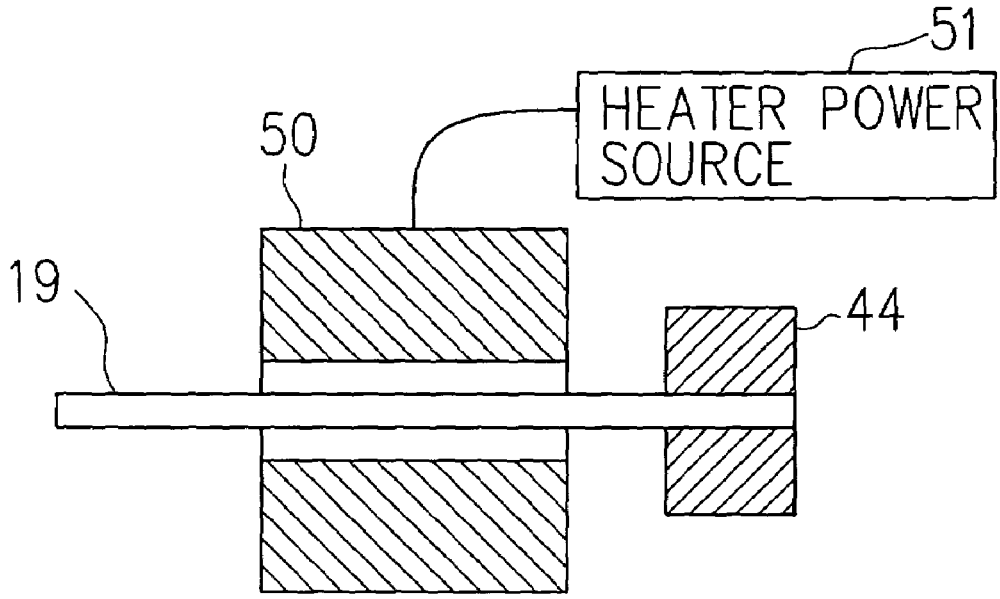
FIG. 7 is an explanatory view illustrating an embodiment that uses a heater to apply heat.

FIG. 7 shows an embodiment that uses a ceramic heater 50 to heat the surface of the adhesion area of the electrode lead 19. It is preferable that the ceramic heater 50 is a ring-shaped with a hole big enough to insert the electrode lead 19 in the axial direction. A heater power source 51 is driven to heat the ceramic heater 50 to transmit the heat to the adhesion area without contacting the electrode lead 19. Similar to the above embodiment, the degree of oxidation can be adjusted by changing the temperature, the heating period of the heater 50, or combinations of these appropriately.

Figure 8:
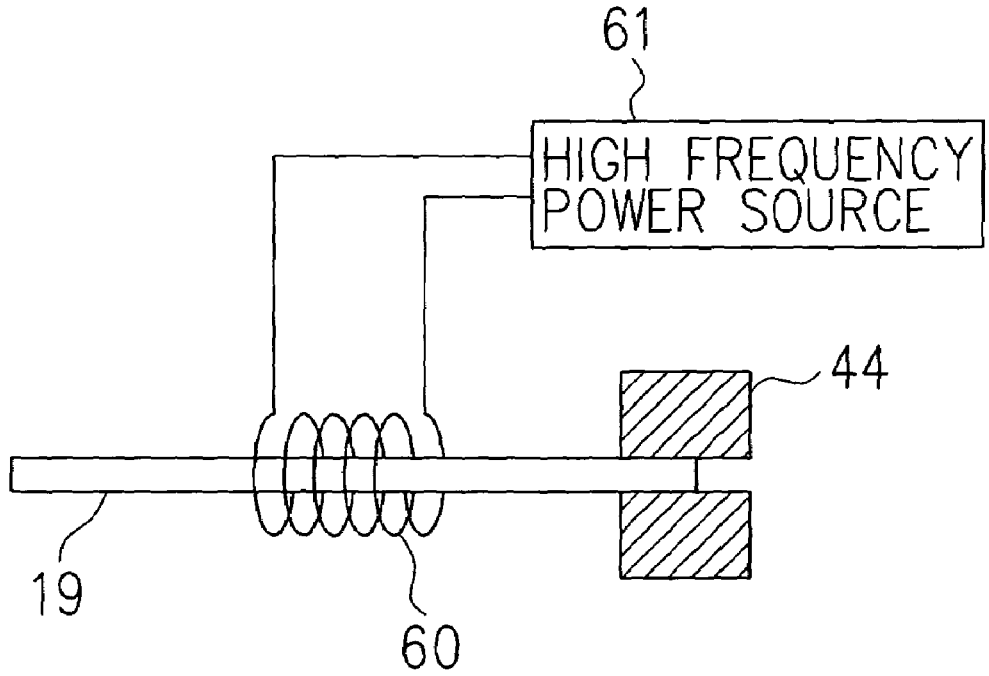
FIG. 8 is an explanatory view illustrating an embodiment to apply heat by use of alternative electrode current.

FIG. 8 shows an embodiment in which a high frequency induction heating device is used to heat the surface of the adhesion area of the electrode lead 19. The high frequency induction heating device consists of a coil section 60 and a high frequency power source 61. The coil section 60 is composed of spiral electric wire that covers the adhesion area without contacting the electrode lead 19. The electric wire is connected to the high frequency power source 61, which generates alternative current with high frequency. Alternative current causes induction current that is flown in the electrode lead 19, so that the surface of the adhesion area is heated. The surface of the adhesion area reacts with oxygen in the air and oxidized. The degree of oxidation can be adjusted by suitably adjusting the electric current, the frequency generated by the high frequency power source 61 and a combination of these to change the heating temperature and heating period.

It is assumed that the surface of the clamp parts of the electrode lead 19 would be slightly oxidized. However, the clamp parts of the electrode lead 19 are not heated so much. This is because the electrode clamps 16, 17 have a large heat capacity in comparison with the electrode lead 19, which results in heat-reduction effect. Thus, compared with the area between the clamped areas, the clamped areas of the electrode lead 19 are not heated so much. Moreover, the clamped areas of the electrode lead 19 are less oxidized as a result of being covered by the electric clamps 16, 17.

In addition to the heat-apply function, the electrode clamps 16, 17 may have another function such as to hold the electrode lead 19. Otherwise, another holding jig may be used to hold the electrode lead 19 while the electrode clamps 16, 17 are energized. And, even if the adhesion area changes in accordance with the shape of the electrode lead 19 and the glass bead, the clamp position of the electrode clamps 16, 17 can be changed appropriately.

Further, according to the above embodiment, after prefusion of the glass bead 30 into the electrode lead 19, fusion of the glass bead 30 into both ends of the glass tube 35 is performed to seal. The present invention does not limited to this, and the glass bead 30 may be fixed to the electrode lead 19 in synchronism with fusion of the glass bead 30 into both ends of the glass tube 35. As a result, it is possible to omit prefusion of the glass bead 30 to the electrode lead 19.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A method for manufacturing a discharge tube having a glass tube into which rare gas is put, a glass bead for sealing an end of said glass tube, and an electrode lead to be fixed to said glass bead, said method comprising:

applying heat to only a predetermined adhesion area of said electrode lead by use of a heat application device to oxidize only a surface of said predetermined adhesion area of said electrode lead; and fixing said glass bead to said adhesion area of said electrode lead.

2. A method as claimed in claim 1, wherein said heat application device comprises a pair of electrode members and a power source that applies a predetermined voltage between said pair of electrode members to heat said adhesion area.

3. A method as claimed in claim 2, wherein at least a portion of said electrode member to contact said electrode lead is made of a conductive material.

4. A method as claimed in claim 2, wherein a degree of oxidation of said adhesion area is adjusted by changing the voltage, the electric current, the energizing period of said power source, or a combination thereof.

5. A method as claimed in claim 1, wherein said heat application device is a laser device that irradiates laser light to said adhesion area of said electrode lead.

6. A method as claimed in claim 1, wherein said heat application device is an infrared light device that irradiates infrared light to said adhesion area of said electrode lead.

7. A method as claimed in claim 1, wherein said heat application device is a heater device that applies heat to said adhesion area of said electrode lead without contacting said electrode lead.

8. A method as claimed in claim 7, wherein said heat application device is a ring-shaped ceramic heater with a hole to insert said electrode lead.

9. A method as claimed in claim 1, wherein said heat application device is a high frequency induction heating device that is composed of a coil section that covers said adhesion area without contacting said electrode lead and a high frequency power source section that generates an alternating current with high frequency to said coil section, thereby induction current is flown in said electrode lead to oxidize only the surface of said adhesion area.

* * * * *